US011485155B2

(12) United States Patent
Yamaguchi et al.

(10) Patent No.: US 11,485,155 B2
(45) Date of Patent: Nov. 1, 2022

(54) RECORDING SYSTEM AND PROCESSING APPARATUS TO PREVENT JAMMING

(71) Applicant: SEIKO EPSON CORPORATION, Tokyo (JP)

(72) Inventors: Shunpei Yamaguchi, Shiojiri (JP); Kohei Ueno, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 112 days.

(21) Appl. No.: 17/029,970

(22) Filed: Sep. 23, 2020

(65) Prior Publication Data

US 2021/0094328 A1 Apr. 1, 2021

(30) Foreign Application Priority Data

Sep. 26, 2019 (JP) ..... JP2019-175247

(51) Int. Cl.

| | |
|---|---|
| ***B41J 13/00*** | (2006.01) |
| ***B65H 31/00*** | (2006.01) |
| ***B65H 43/06*** | (2006.01) |
| ***B65H 31/02*** | (2006.01) |
| *B65H 43/00* | (2006.01) |
| *B65H 37/04* | (2006.01) |

(52) U.S. Cl.

CPC ..... *B41J 13/0045* (2013.01); *B65H 31/00* (2013.01); *B65H 31/02* (2013.01); *B65H 43/06* (2013.01); *B65H 37/04* (2013.01); *B65H 43/00* (2013.01); *B65H 2301/4213* (2013.01); *B65H 2511/152* (2013.01); *B65H 2511/30* (2013.01)

(58) Field of Classification Search

CPC ..... B41J 13/0045; B65H 31/00; B65H 31/02; B65H 43/06; B65H 37/04; B65H 43/00; B65H 2301/4213; B65H 2511/15; B65H 2511/30

See application file for complete search history.

(56) References Cited

U.S. PATENT DOCUMENTS

| | | | | |
|---|---|---|---|---|
| 2009/0316196 | A1* | 12/2009 | Kiriyama ..... | G03G 15/6594 358/1.15 |
| 2015/0117983 | A1 | 4/2015 | Kubota et al. | |
| 2019/0184719 | A1 | 6/2019 | Matsuura et al. | |
| 2019/0248168 | A1* | 8/2019 | Kubo ..... | B65H 31/36 |
| 2021/0122601 | A1* | 4/2021 | Rohman ..... | B65H 31/02 |

FOREIGN PATENT DOCUMENTS

| | | |
|---|---|---|
| JP | 2002-037519 | 2/2002 |
| JP | 2007-204269 | 8/2007 |
| JP | 2008-063077 | 3/2008 |
| JP | 2013-086881 | 5/2013 |
| JP | 2016-023085 | 2/2016 |
| JP | 2019-107829 | 7/2019 |

* cited by examiner

*Primary Examiner* — Henok D Legesse
(74) *Attorney, Agent, or Firm* — Workman Nydegger

(57) ABSTRACT

A recording system includes a recording portion that performs recording on a medium, a stacking portion that stacks the medium recorded by the recording portion, and a processing portion that processes a bundle of media stacked on the stacking portion, in which a controller that controls feeding of the medium to the stacking portion determines a maximum number of sheets of media to be stacked on the stacking portion, based on information on swelling of the medium recorded by the recording portion.

13 Claims, 8 Drawing Sheets

RECORDING SYSTEM AND PROCESSING APPARATUS TO PREVENT JAMMING

The present application is based on, and claims priority from JP Application Serial Number 2019-175247, filed Sep. 26, 2019, the disclosure of which is hereby incorporated by reference here in its entirety.

BACKGROUND

1. Technical Field

The present disclosure relates to a recording system including a recording portion that performs recording on a medium, a stacking portion that stacks the medium recorded by the recording portion, and a processing portion that processes a bundle of media sed on the stacking portion. Further, the present disclosure also relates to a processing apparatus including a stacking portion that stacks a medium recorded by a recording portion that performs recording on the medium, and a processing portion that processes a bundle of media stacked on the stacking portion.

2. Related Art

A media processing apparatus that performs predetermined processing on a medium includes an apparatus that performs stapling or punching processing on a plurality of sheets of media overlapped in a stacking portion that stacks the media, and an apparatus that forms a booklet by performing saddle-stitching of binding the widthwise centers of a plurality of sheets of media overlapped in the stacking portion and then folding the media at a binding position. Such a media processing apparatus is configured as an independent unit and is employed in various forms, such as when installed outside a recording apparatus and constitutes one system as a whole or when built in one housing together with a recording portion for recording on a medium to constitute one system.

As an example, JP-A-2016-023085 discloses a configuration in which a sheet processing apparatus that is an example of a media processing apparatus is provided next to an image forming apparatus that is an example of a recording apparatus. This sheet processing apparatus includes a stacker section that stacks transported sheets in a substantially vertical state, a first binding processing portion that is provided in the stacker section and saddle-stitches the middle binding positions of a bundle of sheets in the sheet transport direction with metal staples, a second binding processing portion that saddle-stitches the middle binding positions of the bundle of sheets in the transport direction without using metal staples, and a folding section that folds the bundle of sheets in the middle.

SUMMARY

When recording is performed by ejecting liquid onto the medium, the medium swells and curls by absorbing the liquid. Therefore, if the maximum number of sheets of media in the stacking portion of the media processing apparatus is uniformly determined in consideration of a certain degree of this curl, when a degree of an actual curl is smaller than originally assumed, the number of media that can be processed may be unnecessarily suppressed, and on the other hand, when the degree of the actual curl is larger than originally assumed, a paper jam may occur inside the apparatus.

The present disclosure is a recording system of the present disclosure including a recording portion that performs recording on a medium, a stacking portion that stacks the medium recorded by the recording portion, and a processing portion that processes a bundle of media stacked on the stacking portion, in which a controller that controls feeding of a medium to the stacking portion determines the maximum number of sheets of media to be stacked on the stacking portion, based on information on the swelling of the medium recorded by the recording portion.

DESCRIPTION OF EXEMPLARY EMBODIMENTS

Figure 1:
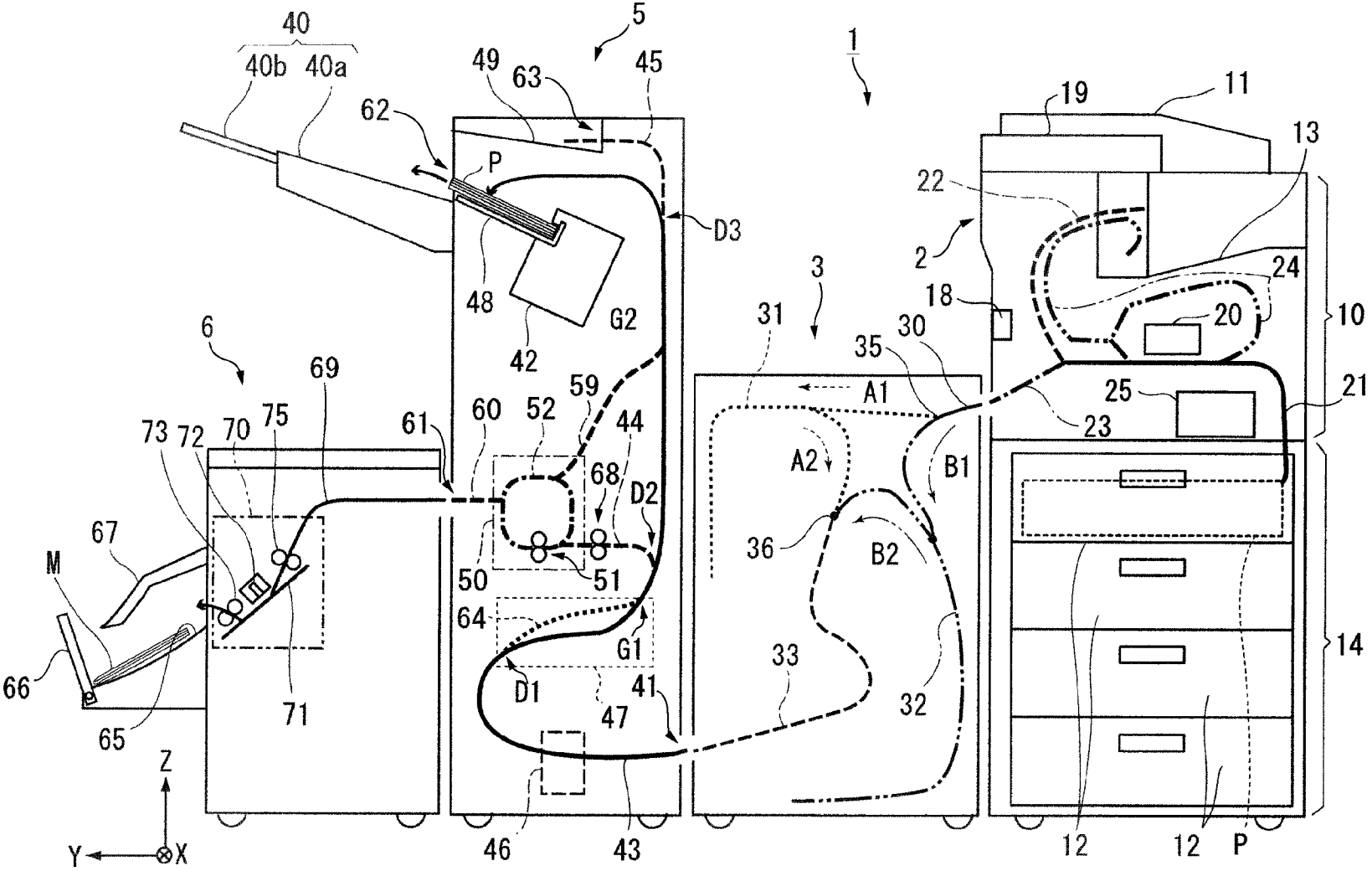
FIG. 1 is a view showing an overall configuration of a recording system.

The present disclosure will be schematically described below. According to a first aspect of the present disclosure, there is provided a recording system including a recording portion that performs recording on a medium, a stacking portion that stacks the medium recorded by the recording portion, and a processing portion that processes a bundle of media stacked on the stacking portion, in which a controller that controls feeding of the medium to the stacking portion determines the maximum number of sheets of media to be stacked on the stacking portion, based on information on swelling of the medium recorded by the recording portion.

According to this aspect, since the controller that controls feeding of a medium to the stacking portion determines the maximum number of sheets of media to be stacked on the stacking portion, based on information on swelling of the medium recorded by the recording portion, the maximum number of sheets may be optimized for each processing from the information on the swelling of the medium that actually occurs. Accordingly, the maximum number of sheets does not match the actual swelling of the medium, and as a result, it is possible to prevent the maximum number of sheets from being unnecessarily suppressed, and it is possible to suppress the possibility that the medium is jammed in the stacking portion.

In a second aspect of the recording system according to the first aspect, the information on the swelling includes information on a grain direction when the medium is paper, and the controller determines the maximum number of sheets based on acquired information on the grain direction. When the medium is paper, the tendency of a curl due to swelling changes depending on the grain direction, but according to this aspect, since the information on the swelling includes information on the grain direction when the medium is paper and the controller determines the maximum number of sheets based on the acquired information on the grain direction, it is possible to appropriately optimize the maximum number of sheets for each processing. The grain is a flow of fibers formed along the longitudinal direction or the lateral direction of paper, depending on the conditions in the manufacturing process of the paper, and the paper has a property that it is hard to bend in the direction orthogonal to the grain and easy to bend in the direction parallel to the grain.

In a third aspect of the recording system according to the first or the second aspect, the information on the swelling includes information on a thickness of the medium, and the controller determines the maximum number of sheets based on acquired information on the thickness. A tendency of a curl due to the swelling of the medium changes according to the thickness of the medium, but according to this aspect, since the information on the swelling includes information on thickness of the medium, and the controller determines the maximum number of sheets based on acquired information on the thickness, it is possible to appropriately optimize the maximum number of sheets for each processing.

In a fourth aspect of the recording system according to any one of the first to third aspects, the recording portion performs recording by ejecting a liquid onto the medium, the information on the swelling includes information on an amount of the liquid ejected onto the medium, and the controller determines the maximum number of sheets based on acquired information on the amount of the liquid.

The tendency of the curl due to swelling of the medium changes depending on the amount of liquid ejected onto the medium, but according to this aspect, since the information on the swelling includes information on an amount of the liquid ejected onto the medium, and the controller determines the maximum number of sheets based on acquired information on the amount of the liquid, it is possible to appropriately optimize the maximum number of sheets for each processing.

In a fifth aspect of the recording system according to any one of the first to the fourth aspects, when the number of bundles of media to be processed by the processing portion, which is designated by a user, exceeds the maximum number of sheets determined based on the information on the swelling, the controller issues a warning to the user, and designated processing is performed based on a user's instruction regarding the warning.

Even if the number of sheets of a bundle of media to be processed by the processing portion, which is designated by the user, exceeds the maximum number of sheets determined based on the information on the swelling, that is, if there is a possibility that a problem may occur, the processing is stopped uniformly, and therefore the convenience for the user may be reduced. According to this aspect, when the number of the bundles of media to be processed by the processing portion, which is designated by a user, exceeds the maximum number of sheets determined based on the information on the swelling, the controller issues a warning to the user, and designated processing is performed based on a user's instruction regarding the warning, and therefore usability is improved.

In a sixth aspect of the recording system according to the fifth aspect, the designated processing based on the user's instruction includes first processing of performing processing while maintaining the number of bundles of media to be processed by the processing portion, which designated by the user and maintaining a recording quality in the recording portion, and second processing of performing processing by changing at least one of the recording quality in the recording portion and transport conditions of the medium from the recording portion to the stacking portion so that the number of the bundles of media to be processed by the processing portion is equal to or less than the maximum number of sheets while maintaining the number of the bundles of media to be processed in the processing portion, which is designated by the user.

According to this aspect, by selecting the first processing, the user can try the processing as originally planned while recognizing the possibility of the jam occurrence. By selecting the second processing, the user can perform the processing in the processing portion while maintaining the number of sheets to be processed as originally planned and suppressing a jam.

In a seventh aspect of the recording system according to any one of the first to sixth aspects, the processing portion includes a binding section that binds the media at a position facing the stacking portion, and a folding section that folds the media at a binding position of the binding section. According to this aspect, in a configuration in which the processing portion includes a binding section that binds the media at a position facing the stacking portion, and a folding section that folds the media at the binding position by the binding section, the operational effect of any of the first to fifth aspects described above may be obtained.

In an eighth aspect of the recording system according to any one of the first to third aspects, the recording portion performs recording by ejecting a liquid onto the medium, the processing portion includes a binding section that binds the media at a position facing the stacking portion, and a folding section that folds the media at a binding position of the binding section, the information on the swelling includes information on an amount of the liquid ejected to an area of the medium passing between the binding section and the stacking portion, and the controller determines the maximum number of sheets based on acquired information on the amount of the liquid.

The binding section has many irregularities on the surface through which the medium passes due to the property thereof, and the medium is easily caught, but on the contrary, it can be said that, in an area of the medium that does not pass between the binding section and the stacking portion, even if a curl occurs, the medium does not get caught in the irregularities. In addition, it can be said that the area between the binding section and the stacking portion tends to be narrow and is greatly affected by the friction between the medium and other members and the friction between the media, and a jam is likely to occur. Therefore, in this aspect, since the information on the swelling includes information on an amount of the liquid ejected to an area of the medium passing between the binding section and the stacking portion, and the controller determines the maximum number of sheets based on acquired information on the amount of the liquid, it is not necessary to suppress the maximum number of sheets unnecessarily, and it is possible to optimize the maximum number of sheets more appropriately.

In a ninth aspect of the recording system according to any one of the first to eighth aspects, the recording portion constitutes an independent recording unit, the stacking portion and the processing portion constitute an independent processing unit, and the controller is provided in the recording unit and controls the processing unit from the recording unit. According to this aspect, in a configuration in which the recording portion constitutes an independent recording unit, the stacking portion and the processing portion constitute an independent processing unit, the controller is provided in the recording unit, and the recording unit controls the processing unit, the operational effect of any of the first to seventh aspects described above may be obtained.

In a tenth aspect of the recording system according to any one of the first to eighth aspects, the recording portion includes an independent recording unit, the stacking portion and the processing portion includes an independent processing unit, and the controller is provided in the processing unit and the information on the swelling is sent from the recording unit to the processing unit.

According to this aspect, in a configuration in which the recording portion constitutes an independent recording unit, the stacking portion and the processing portion constitute an independent processing unit, the controller is provided in the processing unit, and the information on the swelling is sent from the recording unit to the processing unit, the operational effect of any of the first to seventh aspects described above may be obtained.

According to an eleventh aspect of the present disclosure, there is provided a processing apparatus including a stacking portion that stacks a medium recorded by a recording portion that performs recording on the medium, and a processing portion that processes a bundle of media stacked on the stacking portion, in which the maximum number of sheets of media stacked on the stacking portion is determined based on information on swelling of the medium recorded by the recording portion.

According to this aspect, since the maximum number of sheets of media stacked in the stacking portion is determined based on the information on the swelling of the medium recorded by the recording portion, the maximum number of sheets of media can be optimized for each processing from the information on the swelling of the medium that actually occurs. As a result, it is possible to prevent the maximum number of sheets from being unnecessarily suppressed, and it is possible to suppress the possibility that the medium is jammed inside the apparatus.

Hereinafter, the present disclosure will be specifically described. The XYZ coordinate system shown in each drawing is an orthogonal coordinate system, in which an X-axis direction indicates the apparatus depth direction, a Y-axis direction indicates the apparatus width direction, a Z-axis direction indicates the apparatus height direction.

Outline of Recording System

As an example, a recording system 1 shown in FIG. 1 includes a recording unit 2, an intermediate unit 3, a first unit 5, and a second unit 6 as a processing apparatus or a processing unit that is attachable to and detachable from the first unit 5 in order from the right side to the left side in FIG. 1.

The recording unit 2 performs recording on a transported medium. The intermediate unit 3 receives the medium after recording from the recording unit 2 and transfers the medium to the first unit 5, and mainly has a function of reversing the medium and a function of promoting drying of the medium. The first unit 5 is provided with a drying section 50 that performs drying processing on the received medium, and an edge binding section 42 that performs edge binding processing that binds the edges of the media after recording in the recording unit 2 in a bundle. The second unit 6 is provided with a saddle-stitching and folding mechanism 70 that binds and folds the center of a bundle of media after recording in the recording unit 2 into a booklet. In the following, the processing of binding the center of the bundle of media after recording and the processing of subsequently folding the bundle of media will be simply referred to as "saddle-stitching". Hereinafter, the recording unit 2, the intermediate unit 3, the first unit 5, and the second unit 6 will be described in detail in this order.

Regarding Recording Unit

The recording unit 2 is configured as a multifunction machine including a printer section 10 having a line head 20 as a recording portion that performs recording on a medium and a scanner section 11. In the present embodiment, the line head 20 is configured as a so-called ink jet recording head that ejects ink, which is an example of a liquid, onto a medium to perform recording. At the bottom of the printer section 10, a cassette storage section 14 including a plurality of medium storage cassettes 12 is provided. A medium P stored in the medium storage cassette 12 is sent to the recording area by the line head 20 through a feeding path 21 shown by a solid line, and a recording operation is performed. The medium after recording by the line head 20 is sent to either a first discharge path 22 which is a path for discharging the medium to a post-recording discharge tray 13 provided above the line head 20 or a second discharge path 23 which is a path for sending the medium to the intermediate unit 3.

In FIG. 1, the first discharge path 22 is shown by a broken line, and the second discharge path 23 is shown by a dashed line. The second discharge path 23 extends in the +Y direction of the recording unit 2 and transfers the medium to a receiving path 30 of the adjacent intermediate unit 3.

Further, the recording unit 2 includes a reversing path 24 indicated by a chain double-dashed line in FIG. 1, and is configured to be capable of double-sided recording in which the medium is reversed and recording is performed on the second surface after recording on the first surface of the medium. In each of the feeding path 21, the first discharge path 22, the second discharge path 23, and the reversing path 24, one or more pairs of rollers (not shown) are arranged as an example of a means for transporting the medium.

The recording unit 2 is provided with a controller 25 that controls operations related to the transport and recording of the medium in the recording unit 2. In the recording system 1, the recording unit 2, the intermediate unit 3, the first unit 5, and the second unit 6 are mechanically and electrically coupled to each other and are configured so that the medium can be transported from the recording unit 2 to the second unit 6. The controller 25 in the present embodiment can control various operations in the intermediate unit 3, the first unit 5, and the second unit 6 coupled to the recording unit 2.

The recording unit 2 includes an operation section 19, and is configured so that various settings and execution commands regarding various kinds of processing in the recording unit 2, the intermediate unit 3, the first unit 5, and the second unit 6 can be input from the operation section 19. In addition, the operation section 19 includes a display panel (not shown), and is configured to display various information on this display panel. When an external computer (not shown) is coupled to the recording system 1, various settings and execution commands similar to the various settings and execution commands performed by the operation section 19 can be performed in this external computer.

Regarding Intermediate Unit

Next, the intermediate unit 3 will be described. The intermediate unit 3 shown in FIG. 1 transfers the medium received from the recording unit 2 to the first unit 5. The intermediate unit 3 is disposed between the recording unit 2 and the first unit 5. The medium transported through the second discharge path 23 of the recording unit 2 is received by the intermediate unit 3 through the receiving path 30 and transported toward the first unit 5. The receiving path 30 is shown by a solid line in FIG. 1.

In the intermediate unit 3, there are two transport paths for transporting the medium. A first transport path is a path from the receiving path 30 to a merging path 33 via a first switchback path 31 shown by a dotted line in FIG. 1. A second path is a path from the receiving path 30 to the merging path 33 via a second switchback path 32 shown by a chain double-dashed line in FIG. 1. The first switchback path 31 is a path for receiving the medium in an arrow A1 direction and then switching back the medium in an arrow A2 direction. The second switchback path 32 is a path for receiving the medium in an arrow B1 direction and then switching back the medium in an arrow B2 direction.

The receiving path 30 branches into the first switchback path 31 and the second switchback path 32 at a branch section 35. The branch section 35 is provided with a flap (not shown) that switches the destination of the medium to either the first switchback path 31 or the second switchback path 32.

Further, the first switchback path 31 and the second switchback path 32 merge at a merging section 36. Therefore, whether the medium is sent from the receiving path 30 to the first switchback path 31 or the second switchback path 32, the medium can be transferred to the first unit 5 via the common merging path 33.

The intermediate unit 3 receives the medium from the recording unit 2 in the receiving path 30 with the most recent recording surface of the line head 20 facing upward, but in the merging path 33, the medium is curved and reversed, and the most recent recording surface faces downward. Therefore, the medium with the most recent recording surface facing downward is transferred from the +Y direction of the intermediate unit 3 to a first transport path 43 of the first unit 5. In each of the receiving path 30, the first switchback path 31, the second switchback path 32, and the merging path 33, one or more pairs of rollers (not shown) are arranged as an example of a means for transporting the medium.

When recording is continuously performed on a plurality of media in the recording unit 2, the medium that has entered the intermediate unit 3 is alternately sent to the transport path that passes through the first switchback path 31 and the transport path that passes through the second switchback path 32. As a result, the throughput of medium transport in the intermediate unit 3 can be increased.

When recording is performed by ejecting a liquid, specifically ink, onto a medium like the line head 20 of the present embodiment, if the medium is wet when the processing is performed by the first unit 5 and the second unit 6 in the subsequent stage, the recording surface may be rubbed or the medium may have poor consistency. It is possible to lengthen the transport time until the medium after recording is sent to the first unit 5 and further dry the medium before the medium reaches the first unit 5 or the second unit 6 by transferring the medium after recording from the recording unit 2 to the first unit 5 via the intermediate unit 3.

Regarding First Unit

Subsequently, the first unit 5 will be described. The first unit 5 shown in FIG. 1 includes a receiving section 41 that receives the medium from the intermediate unit 3 in the lower side in the −Y direction. The medium transported through the merging path 33 of the intermediate unit 3 enters the first unit 5 from the receiving section 41 and is transferred to the first transport path 43.

The first unit 5 includes the drying section 50 that processes the medium received from the receiving section 41, and the edge binding section 42 that processes the medium received from the receiving section 41 or the medium processed by the drying section 50. The first unit 5 includes the first transport path 43 for sending the medium received from the receiving section 41 to the edge binding section 42, and a second transport path 44 that branches from the first transport path 43 at a second branch section D2 and for sending the medium to the drying section 50. The second branch section D2 is provided with a flap (not shown) that switches the destination of the medium between the first transport path 43 and the second transport path 44.

The edge binding section 42 is a component that performs edge binding processing of binding the edge of the medium, such as a corner on one side of the medium or a side of one side of the medium. The edge binding section 42 includes a stapler as an example. The drying section 50 is a component that performs drying processing on the medium. In the present embodiment, the drying section 50 heats the medium to dry the medium. Although the detailed configuration of the drying section 50 will be described later, the medium after the drying processing by the drying section 50 is sent to either the edge binding section 42 or the saddle-stitching and folding mechanism 70 provided in the second unit 6.

Further, the first unit 5 includes a punching section 46 that performs punch processing on the medium received from the receiving section 41. The punching section 46 is provided at a position near the receiving section 41 on the first transport path 43 through which the medium received by the first unit 5 passes, and is configured to be able to perform punch processing upstream of the first transport path 43. The medium received from the receiving section 41 may or may not be punched by the punching section 46.

The medium received from the receiving section 41 can be sent to a processing tray 48 or the second unit 6 described later through the first transport path 43 shown in FIG. 1. In the processing tray 48, the media are stacked on the processing tray 48 with the rear edges in the transport direction aligned. When a predetermined number of the media P are stacked on the processing tray 48, the edge binding processing by the edge binding section 42 can be performed on the rear edge of the media P. The first unit 5 includes a second discharge section 62 that discharges the medium in the +Y direction. The first unit 5 includes the second discharge section 62, a first discharge section 61 and a third discharge section 63, which will be described later, and is configured to discharge the medium therefrom.

The medium processed by the edge binding section 42 is discharged from the second discharge section 62 to the outside of the apparatus of the first unit 5 by a discharge section (not shown), and is stacked on a first tray 40 that receives the medium discharged from the second discharge section 62. The first tray 40 is provided so as to project from the first unit 5 in the +Y direction. In the present embodiment, the first tray 40 includes a base section 40*a* and an extension section 40*b*, and the extension section 40*b* is configured to be stored in the base section 40*a*.

In addition, a third transport path 45, which branches from the first transport path 43 at a third branch section D3 downstream from the second branch section D2, is coupled to the first transport path 43. The third branch section D3 is provided with a flap (not shown) that switches the destination of the medium between the first transport path 43 and the third transport path 45.

An upper tray 49 is provided above the first unit 5. The third transport path 45 extends from the third branch section D3 to the above-described third discharge section 63, and the medium transported through the third transport path 45 is discharged from the third discharge section 63 to the upper tray 49 by a discharge section (not shown). That is, the medium received from the receiving section 41 can be discharged to the upper tray 49 without passing through the edge binding section 42.

The first transport path 43 is provided with an overlapping path 64 that branches from the first transport path 43 at a first branch section D1 and merges again with the first transport path 43 at a first merging section G1. The overlapping path 64 includes an overlapping section 47 that overlaps two media and sends the media to the drying section 50 or the edge binding section 42. The preceding medium to be transported in advance is sent to the overlapping path 64, and the preceding medium and the succeeding medium can be overlapped and transported downstream from the first merging portion G1 by merging the succeeding medium and the preceding medium transported through the first transport path 43 at the first merging portion G1. The overlapping section 47 may be configured to have a plurality of overlapping paths 64 and overlap three or more media and send the media downstream.

In the first unit 5, the overlapping section 47 is located vertically below the drying section 50, and the drying section 50, the edge binding section 42, and the overlapping section 47 have a section that overlaps when viewed in the vertical direction, that is, when viewed from the top surface. Only drying section 50 and the overlapping section 47 or only the edge binding section 42 and the overlapping section 47 may be overlapped. The size of the apparatus can be reduced by suppressing an increase in the horizontal dimension of the apparatus by arranging the drying section 50, the edge binding section 42, and the overlapping section 47 in such a positional relationship.

In the first unit 5, in each of the first transport path 43, the second transport path 44, and the third transport path 45, a pair of rollers (not shown) are arranged as an example of a means for transporting a medium.

Subsequently, the drying section 50 provided in the first unit 5 will be described. The drying section 50 includes a pair of heat rollers 51 as a drying section that performs drying processing of the medium, and a loop-shaped transport path 52 including the pair of heat rollers 51 and capable of circularly transporting the medium. The second transport path 44 branched from the first transport path 43 merges with the loop-shaped transport path 52 upstream of the pair of heat rollers 51, and the medium can be fed by a pair of transport rollers 68 provided in the second transport path 44 and introduced into the loop-shaped transport path 52.

In the pair of heat rollers 51, the lower roller is a drying drive roller driven by a drive source (not shown) in the present embodiment, and the upper roller is a drying driven roller driven by the rotation of the drying drive roller. The drying drive roller is heated by a heater (not shown), whereby the drying drive roller generates heat and the medium is dried. However, as long as at least one of the rollers forming the pair of heat rollers 51 is heated, both rollers may be heated.

However, the medium sent from the intermediate unit 3 enters the second transport path 44 from the receiving section 41 of the first unit 5 via the first transport path 43 with the most recent recording surface facing downward. Then, the medium is nipped by the pair of heat rollers 51 with the most recent recording surface facing downward. Therefore, it is preferable that the heated roller of the pair of heat rollers 51 be a roller that comes into contact with the most recent recording surface of the medium.

Since the drying section includes the loop-shaped transport path 52 and is configured to be capable of circularly transporting the medium in the loop-shaped transport path 52, it is possible to perform drying processing by the pair of heat rollers 51 a plurality of times by circularly transporting the medium a plurality of times. Therefore, the medium can be dried more reliably. Further, by providing the loop-shaped transport path 52, it is possible to suppress an increase in the cost of the apparatus and power consumption as compared with a case where a plurality of pairs of heat rollers 51 are provided in the transport path, for example.

In the recording system 1, the heating by the pair of heat rollers 51 is controlled by the controller 25 provided in the recording unit 2. The controller 25 can control the heating of the pair of heat rollers 51 according to conditions. Examples of the conditions include the ejection amount of ink ejected onto the medium during recording in the recording unit 2, whether the recording on the medium is double-sided recording or single-sided recording, environmental conditions such as temperature and humidity when drying, in addition to media type, rigidity, thickness, basis weight, and the like. By controlling the heating by the pair of heat rollers 51 according to these conditions, the medium can be dried more appropriately. Examples of the heating control by the pair of heat rollers 51 include heating or not heating, the temperature when heating, whether or not to use residual heat when heating, the timing of starting heating of the pair of heat rollers 51, and the like.

Further, in the pair of heat rollers 51, one drying driven roller is pressed against the other drying drive roller by a pressing section (not shown) such as a spring, and the pressing force of the pressing section can be changed. The nip pressure in the pair of heat rollers 51 can be adjusted by controlling the pressing force changing section (not shown) that changes the pressing force of the pressing section by the controller 25. The nip pressure in the pair of heat rollers 51 is preferably changed according to conditions. As the conditions, the same conditions as the case of controlling the heating by the pair of heat rollers 51 can be used.

A fourth transport path 59 is coupled to the loop-shaped transport path 52. The fourth transport path 59 is a path that merges with the first transport path 43 at a second merging section G2 and returns the medium after the drying processing by the pair of heat rollers 51 to the first transport path 43. Further, a fifth transport path 60 is coupled to the loop-shaped transport path 52. The fifth transport path 60 is a path that is continuous with the first discharge section 61, and is a path that sends the medium after the drying processing by the pair of heat rollers 51 toward the second unit 6. Then, the first unit 5 includes a switching flap (not shown) as a switching member capable of switching between a first state in which the medium processed by the drying section 50 is sent to the first discharge section 61 and a second state in which the medium processed by the drying section 50 is sent to the edge binding section 42.

The drying section 50 may have a configuration without the loop-shaped transport path 52. Further, in the present embodiment, the drying section 50 that dries the medium by heating the medium from the outside has been described, but the drying section 50 can also be configured to dry the medium, for example, by blowing air onto the medium.

Regarding Second Unit

Next, the second unit 6 will be described. The second unit 6 is provided on the lower side of the first tray 40 of the first unit 5 so as to be attachable to and detachable from the first unit 5. The medium transferred from the first discharge section 61 of the first unit 5 to the second unit 6 is transported on the transport path 69 and is sent to the saddle-stitching and folding mechanism 70. The saddle-stitching and folding mechanism 70 includes a stack section 71 as a stacking portion that stacks media, and a bundle of media stacked on the stack section 71 can be bound at a saddle-stitching position and then folded at the saddle-stitching position to form a booklet.

A bundle M of medium subjected to the saddle-stitching by the saddle-stitching and folding mechanism 70 is discharged to a second tray 65 shown in FIG. 1. The second tray 65 includes a restriction section 66 at the tip in the +Y direction, which is the medium discharge direction, and the bundle M of media discharged to the second tray 65 is prevented from protruding from the second tray 65 in the medium discharge direction or falling from the second tray 65. Reference numeral 67 is a guide section 67 that guides the bundle M of media discharged from the second unit 6 to the second tray 65.

Subsequently, the configuration of the saddle-stitching and folding mechanism 70 will be further described with reference to FIGS. 1 and 2. The second unit 6 is provided on the transport path 69, and is provided with a pair of feed rollers 75 as a feed section that transports the medium P, a stack section 71 as a stacking portion that stacks the medium P, and a processing portion 70*a* that performs saddle-stitching on the medium stacked in the stack section 71. The processing portion 70*a* includes a binding mechanism 72 that binds the bundle M of media composed of a plurality of sheets of media P stacked on the stack section 71 at a binding position, and a pair of folding rollers 73 as a folding section that folds the bundle M of media at the binding position.

Figure 2:
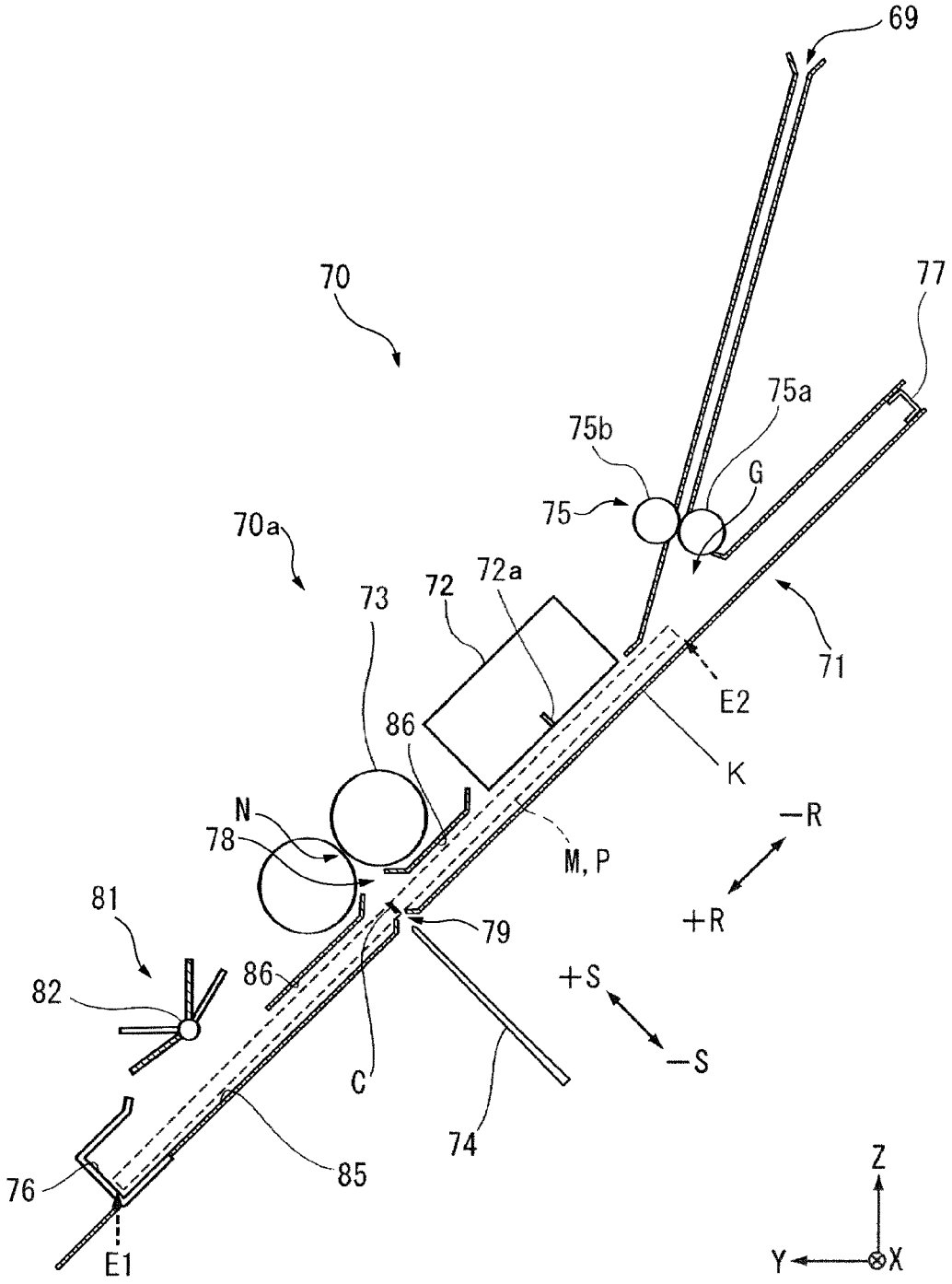
FIG. 2 is a side view of a saddle-stitching and folding mechanism.

As shown in FIG. 2, the stack section 71 is provided with an aligning section 76 that aligns a downstream edge E1 of the stacked media P and a paddle 81. The pair of feed rollers 75 include a drive roller 75*a* driven by a drive source (not shown) and a driven roller 75*b* that is driven to rotate by the rotation of the drive roller 75*a*, and the drive roller 75*a* rotates under the control of the controller 25.

In FIG. 2, the stack section 71 includes a support surface 85 that supports the medium P transported by the pair of feed rollers 75 in an inclined posture in which the downstream side in a transport direction +R faces downward, and the medium P is received and stacked between the support surface 85 and a facing surface 86 facing the support surface 85. The paddle 81 is provided between the pair of feed rollers 75 and the aligning section 76 in the transport direction +R and moves the medium P toward the aligning section 76 by rotating around a rotation shaft 82 while being in contact with the medium P.

In FIG. 2, reference numeral G indicates a merging position G where the transport path 69 and the stack section 71 merge. The binding position in the present embodiment is a central section C in the transport direction +R of the media P stacked in the stack section 71. The medium P is sent to the stack section 71 from the transport path 69 by the pair of feed rollers 75. The stack section 71 is provided with the aligning section 76 that can abut on the downstream edge E1 of the media P stacked in the stack section 71 in the transport direction +R, and an abutting section 77 that can abut on an upstream edge E2 of the media P stacked in the stack section 71 in the transport direction +R.

The aligning section 76 and the abutting section 77 are configured to be movable in both the transport direction +R of the medium P in the stack section 71 and a reverse direction −R thereof. The aligning section 76 and the abutting section 77 can be moved in the transport direction +R and the reverse direction −R by using a rack and pinion mechanism or a belt moving mechanism that operates by the power of a drive source (not shown), for example. The movements of the aligning section 76 and the abutting section 77 will be described in detail when the stacking operation in the stack section 71 is described.

The binding mechanism 72 that binds the bundle M of media stacked in the stack section 71 at a predetermined position in the transport direction +R is provided downstream from the merging position G. The binding mechanism 72 is, for example, a stapler, and binds the bundle M of media at a binding section 72*a* that is an example of binding section. A plurality of binding sections 72*a* are provided at intervals in the X-axis direction that is the width direction of the medium. As described above, the binding mechanism 72 is configured to bind the bundle M of media with the central section C of the bundle M of media in the transport direction as a binding position.

The pair of folding rollers 73 are provided downstream from the binding mechanism 72. The facing surface 86 is open at a position corresponding to a nip position N of the pair of folding rollers 73, and an entry path 78 for the bundle M of media from the stack section 71 to the pair of folding rollers 73 is formed. At the entrance of the entry path 78 of the facing surface 86, a slope is formed to guide the central section C, which is the binding position, from the stack section 71 to the nip position N.

Figure 3:
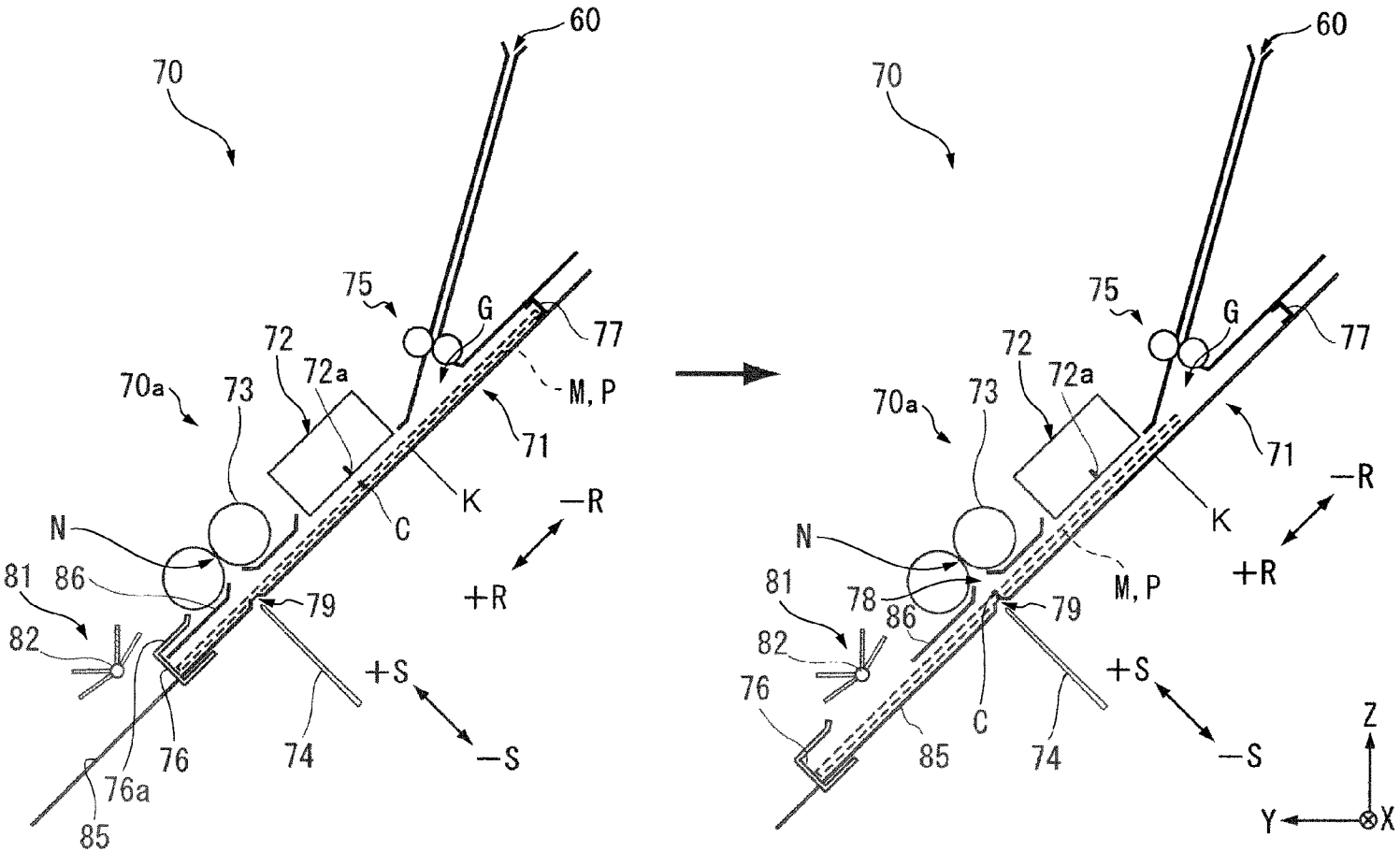
FIG. 3 is a view showing a movement of a medium in the saddle-stitching and folding mechanism.
Figure 4:
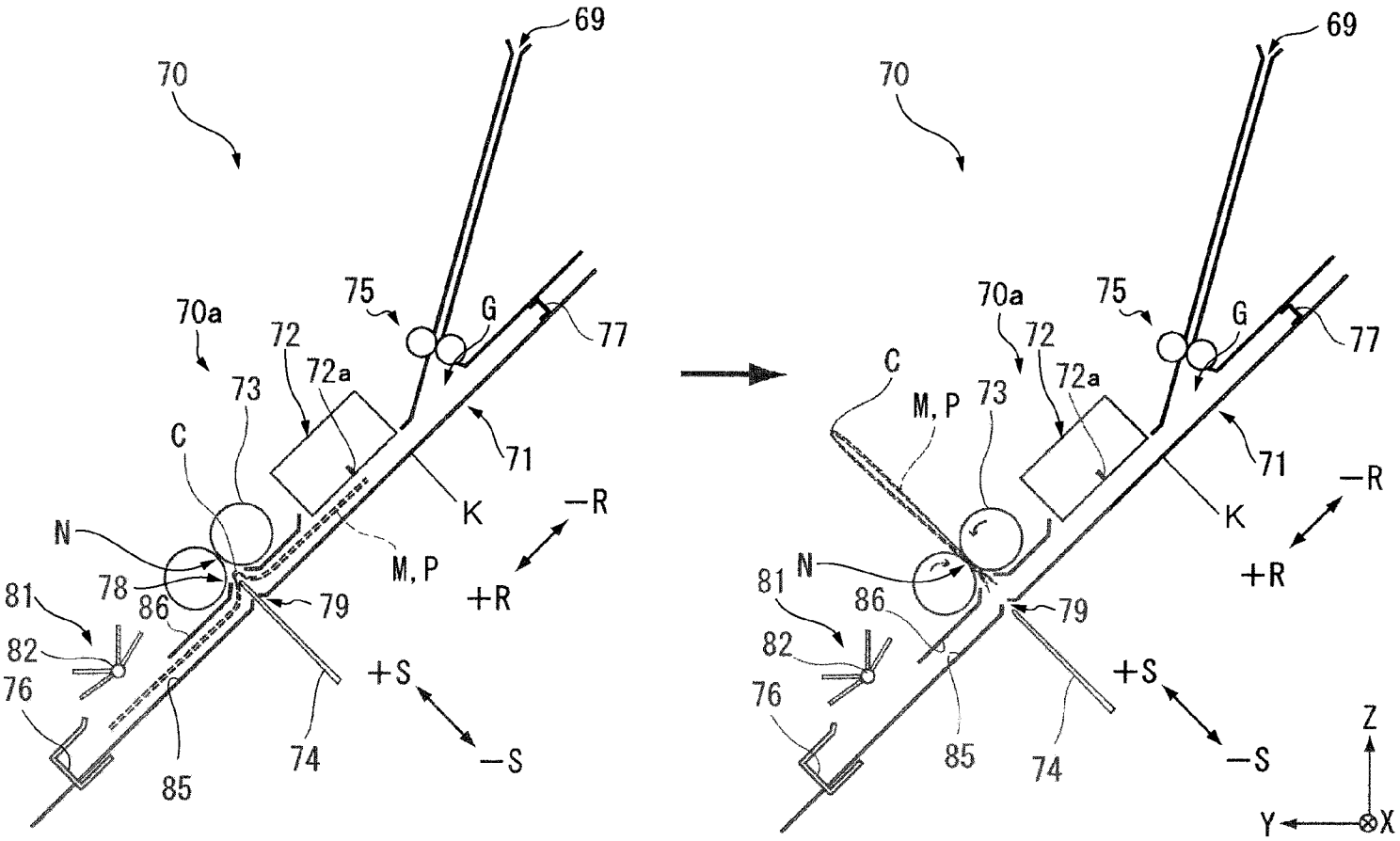
FIG. 4 is a view showing movement of the medium in the saddle-stitching and folding mechanism.

A blade 74 that can switch between a retracted state of being retracted from the stack section 71 as shown in FIGS. 2 and 3 and an advancing state of advancing to the binding position of the bundle M of media stacked in the stack section 71 as shown in the left view of FIG. 4 is provided on the opposite side of the pair of folding rollers 73 with the stack section 71 interposed therebetween. Reference numeral 79 is a hole 79 provided in the support surface 85, and the blade 74 can pass through the hole 79. Regarding Transport of Medium During Saddle-Stitching Next, with reference to FIGS. 2 to 4, a basic flow of transporting the medium P in the second unit 6, performing saddle-stitching, and discharging the medium P will be described. In FIG. 2, the medium P sent to the stack section 71 moves toward the aligning section 76 by the own weight thereof, and each time one medium P is transported, the paddle 81 is rotated and the medium P is abutted against the aligning section 76. FIG. 2 shows a state in which a plurality of sheets of media P overlapped on the stack section 71 are stacked as the bundle M of media.

When the medium is received in the stack section 71, as shown in FIG. 2, the aligning section 76 is disposed such that the distance from the merging position G of the transport path 69 and the stack section 71 to the aligning section 76 is longer than the length of the medium P. As a result, the medium P is received in the stack section 71 without the upstream edge E2 of the medium P transported from the transport path 69 remaining in the transport path 69. The position of the aligning section 76 in the transport direction +R of the stack section 71 can be changed according to the size of the medium P.

When a predetermined number of media P are stacked on the stack section 71, the binding processing of binding the central section C of the bundle M of media in the transport direction +R with the binding section 72*a* is performed. At the time when the transport of the medium P from the transport path 69 to the stack section 71 is completed, as shown in FIG. 2, the central section C is displaced from the position of the binding section 72*a*, and therefore, as shown in the left view of FIG. 3, the aligning section 76 is moved in the −R direction, and the central section C of the bundle M of media is arranged at a position facing the binding section 72*a*. Further, the abutting section 77 is moved in the +R direction to abut on the upstream edge E2 of the bundle M of media. The aligning section 76 and the abutting section 77 align the downstream edge E1 and the upstream edge E2 of the bundle M of media, and the central section C of the bundle M of media is bound by the binding section 72*a*.

When the bundle M of media are bound by the binding section 72*a*, as shown in the right view of FIG. 3, the aligning section 76 is moved in the +R direction, and the bundle M of media are moved so that the bound central section C is arranged at a position facing the nip position N of the pair of folding rollers 73. The bundle M of media can be moved in the +R direction by moving only the aligning section 76 in the +R direction while keeping the bundle M of media in contact with the aligning section 76 by the own weight thereof. The abutting section 77 may be moved in the +R direction so as to maintain the abutting state on the upstream edge E2 of the bundle M of media.

Subsequently, when the central section C of the bundle M of media is arranged at a position facing the nip position N of the pair of folding rollers 73, as shown in the left view of FIG. 4, the blade 74 is advanced in a +S direction to bend the central section C toward the pair of folding rollers 73. The central section C of the bent bundle M of media passes through the entry path 78, and the bundle M of media are moved toward the nip position N of the pair of folding rollers 73.

When the central section C of the bundle M of media is nipped by the pair of folding rollers 73, the pair of folding rollers 73 are rotated, and as shown in the right view of FIG. 4, the bundle M of media are discharged toward the second tray 65 (see FIG. 1) while being folded at the central section C by the nip pressure of the pair of folding rollers 73. Further, after the central section C is nipped by the pair of folding rollers 73, the aligning section 76 moves in the +R direction, returns to the state of FIG. 2, and prepares to receive the next medium P in the stack section 71.

The transport path 69 may be provided with a folding line forming section that makes a folding line at the central section C of the medium P. The bundle M of media can be easily folded at the central section C by providing a folding line at the central section C which is the folding position by the pair of folding rollers 73.

Regarding Restriction in the Number of Media Processed in Second Unit

Next, the limitation on the number of media to be processed in the saddle-stitching and folding mechanism 70 will be described. When recording is performed by ejecting ink, which is an example of a liquid, to the medium, the medium swells and curls by absorbing the ink. Further, due to the increase in the amount of water in the medium due to the ejection of ink onto the medium, the frictional force between the media and the frictional force between the media and other members increases. Therefore, if the maximum number of sheets of media stacked on the stack section 71 of the saddle-stitching and folding mechanism 70 is uniformly determined by considering the curl or a certain degree of increase in the amount of water in the medium due to ink ejection, when a degree of an actual curl or an increase in the amount of water is smaller than originally assumed, the number of media that can be processed will be unnecessarily suppressed, and on the contrary, when the degree of the actual curl or the increase in the amount of water is larger than originally assumed, a paper jam may occur in the saddle-stitching and folding mechanism 70.

Therefore, the controller 25 (see FIG. 1) determines the maximum number of sheets of media stacked in the stack section 71, in other words, the upper limit of the number of media that can be sent to the stack section 71 based on the information on the swelling of the medium recorded by the line head 20. In the following, the maximum number of sheets of media will be referred to as the "maximum number of sheets in the stack section 71" or simply "maximum number of sheets". As a result, the maximum number of sheets in the stack section 71 can be unnecessarily suppressed, and the possibility that the medium is jammed in the saddle-stitching and folding mechanism 70 can be suppressed.

Figure 5:
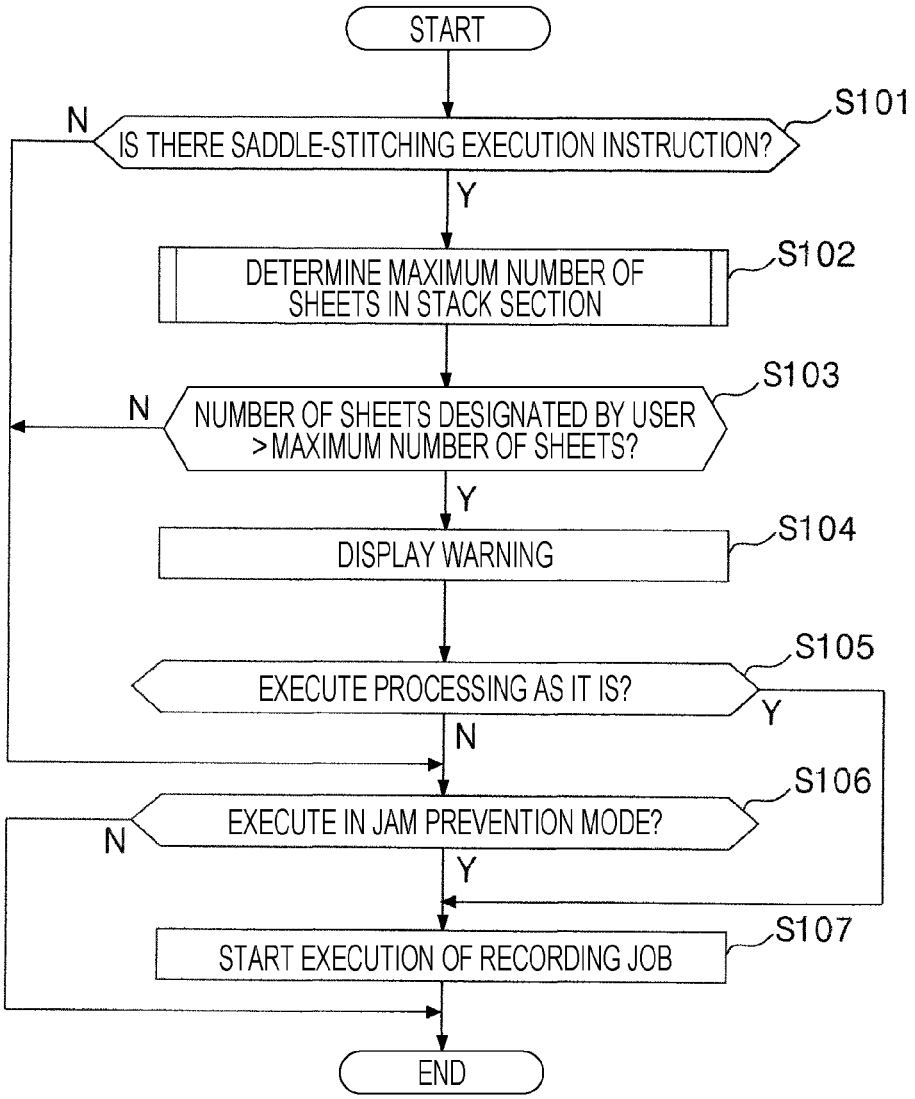
FIG. 5 is a flowchart showing a flow of determination processing regarding saddle-stitching.

The details will be described below. FIG. 5 shows a flow of determination processing regarding saddle-stitching, which is executed by the controller 25. The processing illustrated in FIG. 5 is realized by the controller 25 executing a program stored in a storage section (not shown) included in the controller 25. When the controller 25 receives a series of commands for starting the execution of recording job from the operation section 19 (see FIG. 1), if the recording job includes saddle-stitching in the second unit 6 (Yes in step S101), the controller 25 determines the maximum number of sheets in the stack section 71 (step S102). Details of this step S102 will be described later. If the recording job does not include saddle-stitching (No in step S101), the execution of the recording job is started based on designated settings (step S106).

Next, it is determined whether or not the number of sheets subject to saddle-stitching designated by a user exceeds the maximum number of sheets determined in step S102 (step S103), and if the maximum number of sheets is exceeded (Yes in step S103), a warning display is displayed on a display panel (not shown) included in the operation section 19 (see FIG. 1) (step S104).

This warning display can be, for example, a warning message display that "The number of sheets subject to saddle-stitching exceeds the upper limit. Please select processing." The controller 25 performs designated processing based on the user's instruction regarding this warning. As a result, even when the number of sheets designated by the user exceeds the maximum number of sheets in the stack section 71, that is, when there is a possibility that a problem may occur, usability is improved compared to the case where processing is uniformly stopped.

In the present embodiment, the above-described "designated processing" includes first processing, second processing, and the cancellation of a recording job. The user inputs an instruction via the operation section 19 to perform either the first processing, the second processing, or the cancellation of the recording job. In the first processing, the number of sheets designated by the user in the saddle-stitching is maintained, and the subsequent processing is performed as it is while maintaining the recording quality by the line head 20 (Yes in step S105), and by selecting this processing, the user can try the processing as originally planned while recognizing the possibility of a jam. In the second processing, the number of sheets designated by the user in the saddle-stitching is maintained, at least one of the recording quality by the line head 20 and the transport condition of the medium from the line head 20 to the stack section 71 is changed, and processing is performed so that the number of sheets designated by the user is less than or equal to the maximum number of sheets in the stack section 71. Hereinafter, this processing is referred to as a jam prevention mode (step S106). By selecting the second processing, that is, the jam prevention mode, the user can perform the processing in the saddle-stitching and folding mechanism 70 while maintaining the number of sheets designated by the user as originally planned and suppressing a jam.

As described above, the jam prevention mode is to change at least one of the recording quality at the time of recording by the line head 20, paper transport conditions from the line head 20 to the stack section 71, the transport speed in the loop-shaped transport path 52 in the drying section 50, the number of turns of the medium in the loop-shaped transport path 52, and the heating temperature by the heater in the drying section 50. The change of the recording quality at the time of recording by the line head 20 includes, for example, decreasing the recording density. The change of the paper transport conditions is mainly for promoting the drying of the paper, and examples thereof include lowering the paper transport speed and stopping the paper in the middle of the paper transport path. The change of the transport speed in the loop-shaped transport path 52 may be, for example, decreasing the transport speed. The number of turns of the medium in the loop-shaped transport path 52 can be changed, for example, by increasing the number of turns. Examples of changing the heating temperature by the heater in the drying section 50 include raising the heating temperature. The above-described first processing and second processing are examples, and other processing may be used, or third processing or more processing may be added and processing may be selected therefrom. As an example of such other processing, it may be possible to prompt the user to change the paper type or to reduce the number of sheets designated by the user in the saddle-stitching.

When the first processing is selected (Yes in step S105) and the second processing is selected (Yes in step S106), the controller 25 starts the execution of the recording job according to the contents (step S107). When neither the first processing nor the second processing is selected, that is, when the cancellation of a recording job is selected (No in step S105 and No in step S106), the controller 25 stops the execution of the recording job.

Figure 6:
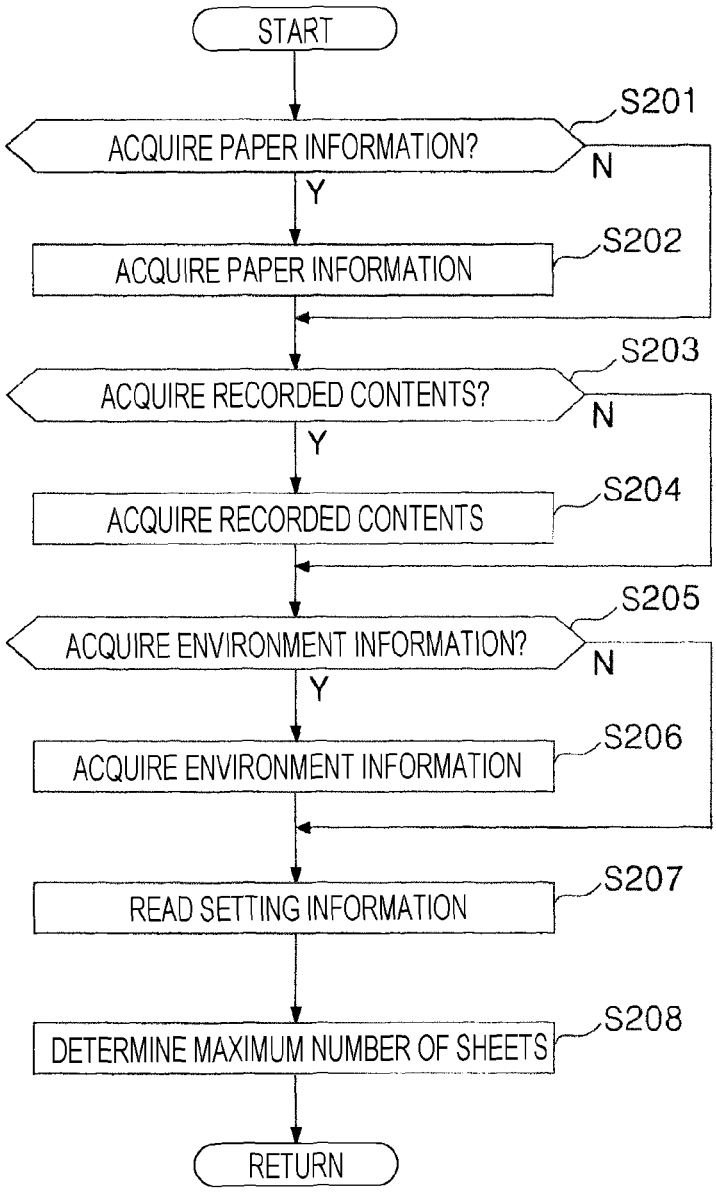
FIG. 6 is a flowchart showing a flow of processing of determining the maximum number of sheets in a stack section.

Next, the details of processing of determining the maximum number of sheets in the stack section 71 will be described with reference to FIG. 6. FIG. 6 shows a flow of processing of determining the maximum number of sheets in the stack section 71, which is executed by the controller 25. The processing shown in FIG. 6 is realized by the controller 25 executing a program stored in a storage section (not shown) included in the controller 25. The controller 25 determines the maximum number of sheets in the stack section 71 based on the information on the swelling of the medium on which recording is performed. The swelling of the medium is swelling that occurs when the medium absorbs the ink when the medium is paper and the liquid is ink, and the swelling further causes a curl. Hereinafter, paper will be described as an example of the medium. The information on the swelling of the paper is information on at least one of all factors that affect the swelling of the paper.

Examples of information relating to factors that affect the swelling of the paper include paper information and recorded contents. The paper information includes factors such as paper size, paper length and width, paper thickness, grain direction, presence or absence of coat layer, and the like. The paper information can be acquired from a printer driver. The grain direction may be input by the user in the operation section 19, or other paper information may be stored in advance in association with the paper size and the paper length and width depending on the destination of the apparatus. This is because the grain direction of the paper has a certain tendency depending on the destination of the apparatus, specifically, the country in which the apparatus is used. Alternatively, a global positioning system (GPS) may be provided in the recording system 1 and the grain direction of the paper may be determined based on the information.

The recorded contents include factors such as the position of the recording area on the paper, the size of the recording area, the shape of the recording area, the amount of ink ejected in the recording area, the presence and absence of double-sided recording, and a difference in the recorded contents between the front surface and the back surface in the case of double-sided recording.

Regarding the paper information, for example, the thicker the paper, the less likely the paper is to swell and curl. Further, paper having a coat layer may be referred to as "glossy paper" or "ink jet paper" on a printer driver, and it can be said that such paper is less likely to swell and curl than paper having no coat layer, which is referred to as "plain paper" on the printer driver.

Figure 7:
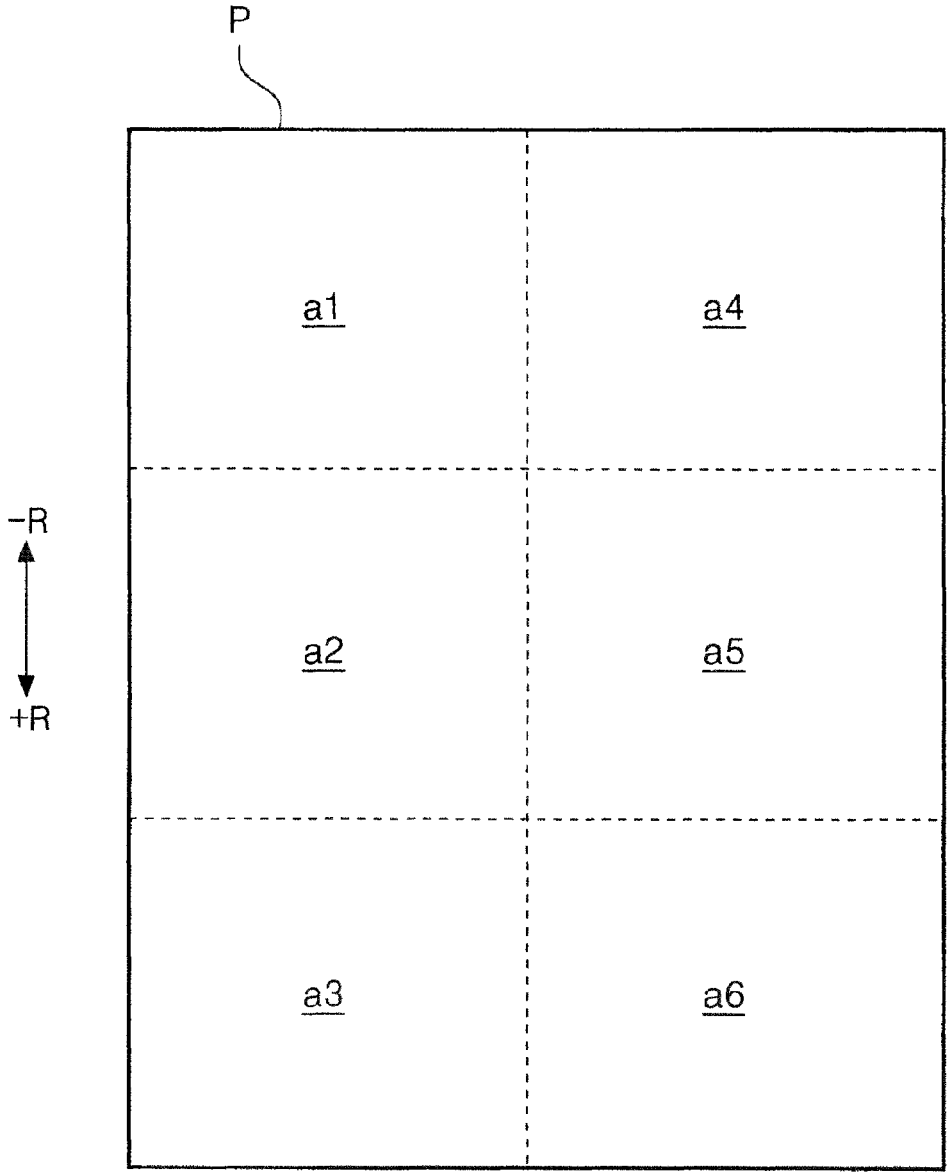
FIG. 7 is a view showing an example of a method for obtaining unevenness of an amount of ink ejected on a sheet.

Regarding the recorded contents, for example, it can be said that the larger the ratio of the recording area to the area of the paper is, the easier the paper is to swell and curl. Further, it can be said that the larger the amount of ink ejected in the recording area, the easier the paper is to swell and curl. Further, it can be said that the more uneven the amount of ink ejected in the area of the paper, the more uneven the swelling is and the easier the paper is to curl. Here, the paper is divided into several areas, and areas a1, a2, a3, a4, a5, and a6 are set like paper P shown in FIG. 7, and the unevenness of the amount of ink ejected in the area of the paper can be obtained by the difference in the amount of ink ejected between the area having the largest amount of ink ejected and the area having the smallest amount of ink ejected. Further, when single-sided recording is performed on paper, it can be said that the easier the paper is to curl because the difference in the amount of water between the front surface and the back surface is large as compared with the case where double-sided recording is performed. Further, when double-sided recording is performed, it can be said that the more remarkable the difference in the recorded contents between the front surface and the back surface is, the more uneven the swelling is and the easier the paper is to curl. The difference in the recorded contents between the front surface and the back surface can be obtained, for example, by the difference between the amount of ink ejected on the front surface and the amount of ink ejected on the back surface.

In addition, when determining the maximum number of sheets in the stack section 71, the controller 25 may consider information on factors that affect the dry state of the recording paper. Examples of the information on the factors that affect the dry state of the sheet include environmental information. The environment information includes factors such as temperature and humidity, for example. In the recording system 1, the recording unit 2 is provided with an environment information acquisition section 18 (see FIG. 1), and the controller 25 (see FIG. 1) can acquire the temperature and humidity inside the recording unit 2 from the environment information acquisition section 18. Regarding the environmental information, for example, the lower the temperature is or the higher the humidity is, the more difficult it is to dry, and therefore the frictional force between the sheets tends to be large, and the stiffness of the sheets tends to weaken. That is, it can be said that a jam is likely to occur.

The storage section of the controller 25 holds the setting information of the maximum number of sheets determined based on the above properties, and the controller 25 refers to the setting information of the maximum number of sheets to determine the maximum number of sheets in the stack section 71. Information on the swelling of these sheets, such as the paper information, the recorded contents, and the environmental information, may be considered, or any one or two thereof may be considered. The setting can be performed by a user operation, and the user can select the information to be considered by the operation section 19 (see FIG. 1) and save the selection as a set value.

As shown in FIG. 6, when acquiring the paper information based on the set information (Yes in step S201), the controller 25 acquires the paper information (step S202), when acquiring the recorded contents (Yes in step S203), acquires the recorded contents (step S204), and when acquiring the environment information (Yes in step S205), acquires the environment information (step S206). Then, the setting information is read (step S207), and the maximum number of sheets is determined (step S208).

Table 1 shows an example of the setting information. In this example, as the information on the swelling of the sheet, a recording density Pd (%) of the recorded contents and a humidity Hm (%) of the environment information are used. Here, the recording density Pd (%) is a value that increases or decreases according to the ink ejection amount, and is the ratio of the total amount of ink ejected (g) to the maximum amount of ink to be ejected (g) in the recordable area of one sheet. That is, the recording density Pd (%)=[total amount of ink ejected (g)/maximum amount of ink to be ejected (g)]×100. The maximum amount of ink to be ejected (g) in the recordable area of one sheet can be obtained from the maximum amount of ink to be ejected (g) per unit area by the line head 20 provided in the recording unit 2. Further, the recording density (%) is not limited thereto, and may be the ratio of the area where ink is ejected to the area of one sheet.

TABLE 1

| Hm\Pd | 0% | 10% | 20% | . . . | 80% | 90% | 100% |
|---|---|---|---|---|---|---|---|
| 0% | 20 | 20 | 20 | . . . | 16 | 15 | 15 |
| 10% | 20 | 20 | 20 | . . . | 16 | 15 | 15 |
| 20% | 20 | 20 | 20 | . . . | 16 | 15 | 15 |
| . | . | . | . | | . | . | . |
| . | . | . | . | | . | . | . |
| . | . | . | . | | . | . | . |
| 80% | 20 | 20 | 20 | . . . | 15 | 14 | 14 |
| 90% | 18 | 18 | 18 | . . . | 14 | 13 | 13 |
| 100% | 18 | 18 | 18 | . . . | 13 | 13 | 13 |

The numerical values in Table 1 are an example of the maximum number of sheets in the stack section 71. For example, when the humidity Hm=0% and the recording density Pd=20%, the maximum number of sheets is 20. When the humidity Hm=100% and the recording density Pd=20%, the maximum number of sheets is 18. The higher the humidity Hm (%), the lower the maximum number of sheets, and the higher the recording density Pd (%), the lower the maximum number of sheets. Such setting information is set and stored for each paper type.

Instead of such setting information, for example, the maximum number of sheets may be calculated by a mathematical expression. For example, a coefficient k may be set for each factor related to the swelling of the paper with respect to a specified value M of the maximum number of sheets, the specified value M may be sequentially multiplied by the coefficient k, and the finally obtained value may be used as the maximum number of sheets in the stack section 71. The specified value M can be obtained by dividing the maximum height of stacking in the stack section 71 by the sheet thickness. Table 2 shows an example of a coefficient ka set according to the humidity Hm (%). As described above, the maximum number of sheets in the stack section 71 can be obtained by setting the coefficient for each condition regarding the factors related to the swelling of the paper and multiplying the coefficient by the specified value M of the maximum number of sheets.

TABLE 2

| Hm | ka |
|---|---|
| 0% | 1.0 |
| 10% | 1.0 |
| 20% | 1.0 |
| . | . |
| . | . |
| . | . |
| 80% | 1.0 |
| 90% | 0.9 |
| 100% | 0.9 |

Further, the sheet size, the sheet thickness, the grain direction, and the presence and absence of the coat layer can be used to determine the direction and the amount of deformation of the sheet due to swelling and then a curl. For example, a curl due to swelling of the paper is likely to occur in the direction intersecting the grain direction, and the larger the size of the paper in the direction intersecting the grain direction, the greater the amount of deformation due to the curl. Since the maximum height of stacking in the stack section 71 is reduced by the amount of deformation of the sheets due to the curl, the maximum number of sheets in the stack section 71 is reduced accordingly. Further, since the paper is supported in the stack section 71 in an inclined posture so as to be inclined downward in the transport direction +R, the paper is easily bent in the transport direction +R on the stack section 71 due to the action of the own weight thereof. Therefore, when the grain direction of the paper is along the X-axis direction, that is, the medium width direction, the rigidity in the transport direction +R is lower than that in the case where the grain direction is along the transport direction +R, and bending is relatively likely to be formed. In this way, the information on the grain direction can also be used to determine the direction and amount of deformation of the sheet.

As described above, in the above-described embodiment, since the controller 25 determines the maximum number of sheets in the stack section 71 based on the acquired information on the grain direction, it is possible to appropriately optimize the maximum number of sheets for each processing.

Further, in the above-described embodiment, since the controller 25 determines the maximum number of sheets in the stack section 71 based on the acquired information on the sheet thickness, it is possible to appropriately optimize the maximum number of sheets for each processing.

Further, in the above-described embodiment, since the controller 25 determines the maximum number of sheets based on the acquired information on the amount of ink ejected onto the paper, it is possible to appropriately optimize the maximum number of sheets for each processing.

Figure 8:
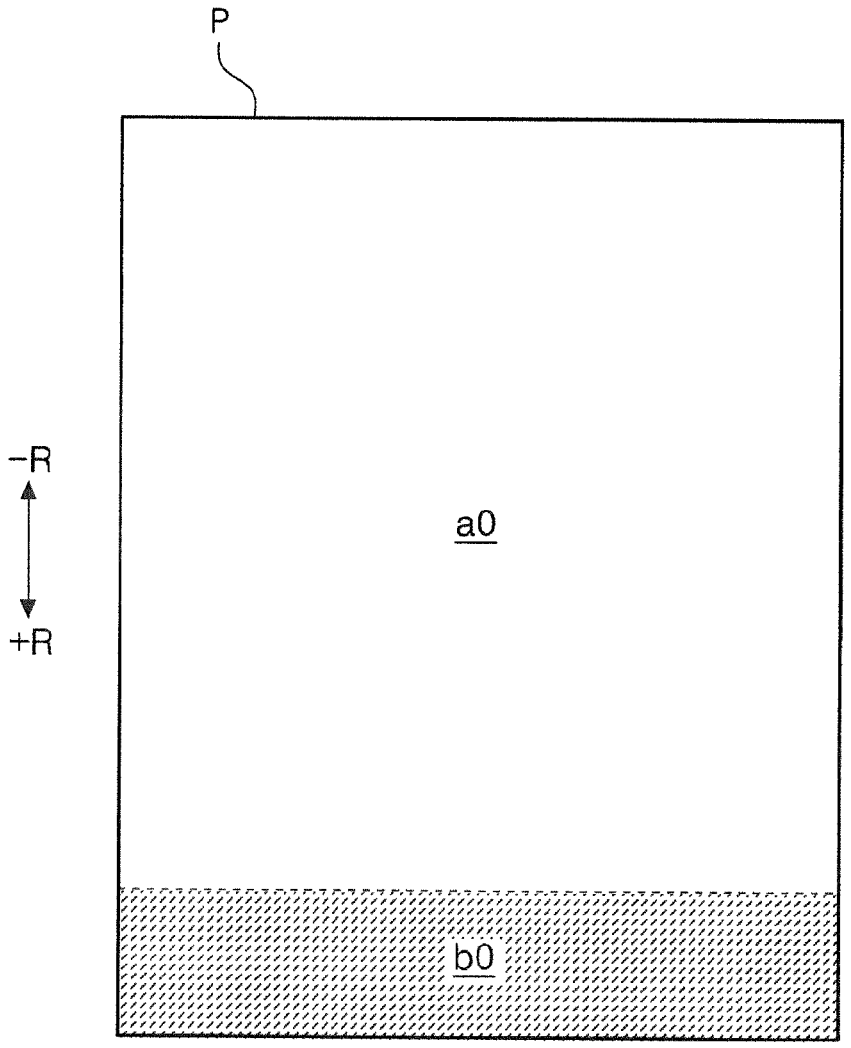
FIG. 8 is a view showing an example of an area of a sheet that passes between a binding unit and the stack section.

Regarding the recorded contents, which is an example of the information on the swelling of the paper, it is also possible to include the information on the amount of the ink ejected to the area of the paper passing between the binding mechanism 72 and the stack section 71, and the controller 25 can also determine the maximum number of sheets based on the acquired information on the amount of ink. That is, the binding mechanism 72 has many irregularities on the surface through which the paper passes due to the property thereof, and the paper is easily caught, but on the contrary, it can be said that, in an area of the paper that does not pass between the binding mechanism 72 and the stack section 71, even if a curl due to swelling occurs, the paper does not get caught in the irregularities of the binding mechanism 72. Specifically, in FIG. 2, the area that enters from a position k into the +R direction is an area where the paper is easily caught in the binding mechanism 72 due to the curl caused by the swelling. FIG. 8 shows an example of the sheet P, and an area a0 is an area that enters from the position k in FIG. 2 in the +R direction, and an area b0 is the other area. Therefore, the controller 25 can determine the maximum number of sheets in the stack section 71 in consideration of the recorded contents in the area a0 without considering the recorded contents in the area b0. As a result, it is not necessary to unnecessarily suppress the maximum number of sheets in the stack section 71, and it is possible to more appropriately optimize the maximum number of sheets in the stack section 71.

In the above embodiment, the recording unit 2 including the line head 20 is an independent unit, the second unit 6 including the stack section 71 and the binding mechanism 72 is an independent unit, and the controller 25 is provided in the recording unit 2 and is configured to control the second unit 6 from the recording unit 2.

Instead of such a configuration, a controller (not shown) that controls the saddle-stitching and folding mechanism 70 is provided for the second unit 6, and information on swelling may be sent from the controller 25 of the recording unit 2 to the controller, and the controller included in the second unit 6 may control the saddle-stitching and folding mechanism 70 based on the information. The controller that controls the saddle-stitching and folding mechanism 70 may be provided in an apparatus other than the recording unit 2 and the second unit 6. Further, not only the second unit 6 but also the intermediate unit 3 and the first unit 5 are respectively provided with controllers (not shown), and these controllers may control the operations of the intermediate unit 3 and the first unit 5 based on the information from the controller 25 of the recording unit 2.

In the recording system 1, the intermediate unit 3 and the first unit 5 may be omitted. At that time, the recording unit 2 and the second unit 6 may be independent units, or the recording unit 2 and the second unit 6 may be integrated. That is, more specifically, the recording system may be configured to include the line head 20 and the saddle-stitching and folding mechanism 70. As described above, in the present specification, the recording system 1 may be either a collection of independent units or a single unit.

The present disclosure is not limited to the embodiment described above, and various modifications are possible within the scope of the disclosure described in the claims, and it is needless to say that the modifications are also included in the scope of the disclosure.

What is claimed is:

1. A recording system comprising:

a recording portion that performs recording on a medium;

a stacking portion that stacks the medium recorded by the recording portion; and a processing portion that processes a bundle of media stacked on the stacking portion, wherein a controller that controls feeding of the medium to the stacking portion determines a maximum number of sheets of media to be stacked on the stacking portion to prevent jamming of the processing portion, based on information on swelling of the medium recorded by the recording portion.

2. The recording system according to claim 1, wherein the information on the swelling includes information on a grain direction when the medium is paper, and the controller determines the maximum number of sheets based on acquired information on the grain direction.

3. The recording system according to claim 1, wherein the information on the swelling includes information on a thickness of the medium, and the controller determines the maximum number of sheets based on acquired information on the thickness.

4. The recording system according to claim 1, wherein the recording portion performs recording by ejecting a liquid onto the medium, the information on the swelling includes information on an amount of the liquid ejected onto the medium, and the controller determines the maximum number of sheets based on acquired information on the amount of the liquid.

5. The recording system according to claim 1, wherein when the number of sheets included in the bundle of media to be processed by the processing portion, which is designated by a user, exceeds the maximum number of sheets determined based on the information on the swelling, the controller issues a warning to the user and performs designated processing based on a user's instruction regarding the warning.

6. The recording system according to claim 5, wherein the designated processing based on the user's instruction includes first processing of performing processing while maintaining the number of sheets included in the bundle of media to be processed by the processing portion, which is designated by a user, and maintaining a recording quality in the recording portion, and second processing of performing processing while maintaining the number of sheets included in the bundle of media to be processed in the processing portion, which is designated by the user, by changing at least one of the recording quality in the recording portion and transport conditions of the medium from the recording portion to the stacking portion.

7. The recording system according to claim 1, wherein the processing portion includes a binding section that binds the media and a folding section that folds the media at a binding position by the binding section, at a position facing the stacking portion.

8. The recording system according to claim 1, wherein the recording portion performs recording by ejecting a liquid onto the medium, the processing portion includes a binding section that binds the media at a position facing the stacking portion, and a folding section that folds the media at a binding position of the binding section, the information on the swelling includes information on an amount of the liquid ejected to an area of the medium passing between the binding section and the stacking portion to the folding section, and the controller determines the maximum number of sheets based on acquired information on the amount of the liquid.

9. The recording system according to claim 1, wherein the recording portion constitutes an independent recording unit, the stacking portion and the processing portion constitute an independent processing unit, and the controller is provided in the recording unit and controls the processing unit from the recording unit.

10. The recording system according to claim 1, wherein the recording portion constitutes an independent recording unit, the stacking portion and the processing portion constitute an independent processing unit, and the controller is provided in the processing unit and controls the processing unit based on the information on the swelling sent from the recording unit to the processing unit.

11. The recording system according to claim 1, wherein the information on swelling comprises information on a grain direction when the medium is paper that is (i) pre-stored in a storage of the recording system based upon a country of destination of the recording system, or (ii) determined based upon a global position of the recording system.

12. A processing apparatus comprising:

a stacking portion that stacks a medium recorded by a recording portion that performs recording on the medium; and a processing portion that processes a bundle of media stacked on the stacking portion, wherein a maximum number of sheets of media stacked on the stacking portion is determined based on information on swelling of the medium recorded by the recording portion and to preventing jamming of the processing portion.

13. A recording system comprising:

a recording portion that performs recording on a medium;

a stacking portion that stacks the medium recorded by the recording portion; and a binding section that binds a bundle of media stacked on the stacking portion at a position facing the stacking portion; and a folding section that folds the media at a binding position by the binding section, wherein a controller that controls feeding of the medium to the stacking portion determines a maximum number of sheets of media to be stacked on the stacking portion to prevent jamming of the binding section, based on information on swelling of the medium recorded by the recording portion, and the medium passes between the binding section and the stacking portion to the folding section.

* * * * *